United States Patent [19]

Cramer

[11] 4,187,912

[45] Feb. 12, 1980

[54] METHOD AND APPARATUS FOR PUMPING FLUIDS FROM BORE HOLES

[76] Inventor: Robert L. Cramer, Rising Star, Tex. 76471

[21] Appl. No.: 852,463

[22] Filed: Nov. 17, 1977

[51] Int. Cl.[2] ..... E21B 43/00; E21B 47/04; E21B 47/12

[52] U.S. Cl. ..... 166/314; 166/53; 166/68; 166/107; 166/250; 166/325

[58] Field of Search ..... 166/53, 68, 105, 107, 166/108, 109, 110, 111, 250, 314, 325

[56] References Cited

U.S. PATENT DOCUMENTS

| | | | |
|---|---|---|---|
| 280,139 | 6/1883 | Crowley | 166/314 |
| 1,634,085 | 6/1927 | Ryan | 166/314 X |
| 1,916,070 | 6/1933 | Otis | 166/314 |
| 2,087,590 | 7/1937 | Brazell | 166/107 |
| 2,593,497 | 4/1952 | Spearow | 166/68 X |
| 3,014,531 | 12/1961 | Weaver | 166/325 X |
| 3,300,983 | 1/1967 | Dougherty et al. | 166/68 X |
| 3,643,740 | 2/1972 | Kelley | 166/314 X |
| 3,915,225 | 10/1975 | Swink | 166/53 |
| 4,019,576 | 4/1977 | Finch | 166/314 X |
| 4,035,023 | 7/1977 | Cockrell | 166/105 X |

FOREIGN PATENT DOCUMENTS

| | | | |
|---|---|---|---|
| 1180417 | 6/1959 | France | 166/53 |

*Primary Examiner*—Stephen J. Novosad
*Assistant Examiner*—George A. Suchfield
*Attorney, Agent, or Firm*—Kermith F. Ross

[57] ABSTRACT

Well pumping method and apparatus by means of which the liquid level and, correspondingly, the hydrostatic pressure, in a bore hole or well casing, is controlled by means of a vertically adjustable sump for receiving liquid from the bore hole or casing before it is pumped to the surface, the sump having therein a pump which is actuated by the liquid level in the sump so that liquid cannot rise in the bore hole or casing above the top or inlet of the sump, as the liquid enters the sump at this point and is pumped to the surface from the sump, the operation being such that the liquid level in the bore hole or casing is controlled by vertically positioning the sump so that the height of the column of liquid in the casing or borehole above the point where liquid is coming from the formation can be maintained at a minimum with consequent increase in the differential hydrostatic pressure between that in the well bore and that in the formation in the direction of the well bore, enabling the maximum rate of liquid entry into the well bore.

The sump prevents water from the lower portion of the formation from coming into direct contact with the pump and being pumped directly to the surface to exclude oil from being pumped to the surface.

Using the sump, the action of the water is such that the water will rise in the annulus between the outer sump wall and the inner wall of casing or bore hole and pass over the lip and into the sump without impeding the flow of oil from out of the upper portion of the formation, the oil also passing into the sump and also being pumped to the surface together with the water entering the casing or bore hole.

20 Claims, 6 Drawing Figures he −hw = DRIVING HEAD FROM FORCE OF GRAVITY

BLOCK DIAGRAM — MAIN CONTROL UNITS

METHOD AND APPARATUS FOR PUMPING FLUIDS FROM BORE HOLES

BACKGROUND OF THE INVENTION

It is well known that oil wells have a limited oil producing life and that beginning from the first oil production, a steady progression of declining production is characteristic. Normally, but not necessarily, an oil well will begin its oil production life producing clean oil but eventually water in increasing amounts will also be produced until the water percentage is so great as to cause continued production to be infeasible. Decline of formation pressure caused by fluid withdrawals may also result in less fluid entering the well bore.

In those cases, particularly in oil reservoirs having underlying water, where the well produces increasing amounts of water and decreasing amounts of oil, water coning is occurring. Water breaks into the well bore and as it does, pushes the oil back from the well bore effectively preventing further oil production.

The original water-oil contact is held in balance by upward gradients in the oil zone which is the energy that will drive the oil into the well bore. These gradients are increased when the pressure is reduced inside the well bore by pumping and a water cone beings to rise above the original water-oil contact. The growth of a water cone is schematically depicted in FIG. 1. Ultimately, the tip of the cone encounters increasingly steep pressure gradients so as to overcome the downward differential-gravity gradient between the oil and water causing the cone to break into the well bore.

It is the object of the present invention to intercede the top portion of the water cone with the top of the sump so that the water can be drawn off and out of the well bore through the sump and to prevent the water cone from rising above the top of the sump. This in turn will prevent the water cone from pushing oil back from the well bore while at the same time leaving the formation face above the top of the sump free of water which will allow oil to enter the well bore unimpeded. Consequently both oil and water will enter the sump and be pumped together to the surface, the oil to be saved and marketed, the water to be reinjected or used in another manner.

Gravity drainage is applicable to oil reservoirs and is known to be a very efficient and effective driving mechanism.

Since it is a purpose of the sump to constantly maintain a fluid level in the well bore below the top of the formation, that part of the formation between its top and the well bore fluid level, this distance being the measure of the driving head, is draining fluid out of the formation by the force of gravity which is in addition to any other forces acting to move formation fluids into the well bore. Accordingly, it is an objective of this invention to prevent any inference with the energy of gravity or any other energy driving fluid into the well bore. This is illustrated by FIG. 2 which schematically represents an oil bearing formation with underlying water, showing the measure of the driving head, he-hw, "he" meaning thickness of the formation and "hw" meaning water height; the area A where fluids enter the well bore the zone drained through the sump of movable fluids represented by the triangle x, y, z.

It is an object of this invention to shield the pump from having direct straight line contact with fluids having high water content. The walls of the sump which enclose the pump act as a shield since the fluids must rise in the bore hole high enough to flow over the lip of the sump and down to the pump. Without the sump to act as a shield, fluids will be drawn predominately from that portion of the formation yielding predominately water (from either underlying water or from the water cone) and the well will yield all, or predominately water at the expense of oil production. Also, since the sump is physically positioned in the well bore to be adjacent that part of the formation yielding predominately water, the walls of the sump will tend to impede the flow of water by back pressure created and by the creation of a damming effect, both result tending to reduce the volume of water that would otherwise enter the bore hole. At the same time, oil will move more freely into the well bore from that portion of the formation above the top of the sump. This is illustrated by FIG. 3, schematically depicts water entering the well bore to be drawn off at B, section A-B indicatiang where oil enters the well bore, unimpeded by water, and section B-C showing where the back pressure and damming effect will occur.

It is an object of the present invention to provide a more effective well production system for use with secondary oil recovery in those cases where the oil formation exhibits high porousness and permeability in conjunction with the use of high water injection pressures. In these situations a condition is created where the oil bank may become established and move so rapidly that the producing wells may exhibit a brief increase of oil production and shortly thereafter turn to all water production. Conventional pumping systems using walking beam pump jack, sucker rods and downhole insert type pumps have a narrow range of operating conditions compared to pumping systems using a submersible pump with the automatic on-off switching system. The submersible pump with sump and automatic on-off switching system of this invention has a much broader range of fluid producing capacity and will substantially prevent the result which occurs when a secondary oil bank overrides and by-passes the conventional walking beam pump jack, sucker rod, downhole insert type pump system. Another objective of the invention is to prevent, after an oil bank is present beneath the producing wells, the possibility is that water cones may form rapidly enough to result in a producing well prematurely going to water production.

It is an objective of the present invention to provide a more effective oil production system in those cases where the oil formation exhibits high permeability and wherein the horizontal permeability and the vertical permeability are very nearly of the same values. This condition, which results in very rapid water coning in even early production, is characterized with very high amounts of water with an attendant low amount of oil being pumped. Use of the combination of this invention of the oil well sump enclosing the submersible pump positioned between the top of the formation and the original oil-water contact results in an increase of oil production since the sump causes most of the water to be drawn from the formation at a point approximately even with or a little above the top of the sump while at the same time reducing any impediment to the flow of oil into the well bore from above the top of the sump.

It is another objective of the present invention to provide a more effective production system in those cases where the bore hole has been inadvertently drilled crooked. The conventional pumping system with walking beam pump jack, sucker rod, downhole insert type pump consists of a pumping action whereby the sucker rod string moves up and down inside the production tubing. In a crooked hole both the production tubing and the sucker rod string bend together as they must to conform to the crookedness of the hole. At the points of bends the sucker rod string rubs against the tubing with an up and down motion which eventually abraids a hole in the production tubing or abraids through the sucker rod string requiring ever re-occurring repair work. The sump submersible pump combination, not having up-down moving parts, can be lowered in crooked holes that will not tolerate a production tubing-sucker rod string system.

It is an objective of the present invention to provide a fully automatic means to keep the bore hole voided at all times above the sump through the use of switches actuated on-off by responding to the position of the fluid level in the sump.

SUMMARY OF THE INVENTION

Pumping method and apparatus for pumping fluids from a bore hole in a fluid producing formation or a well casing in the bore hole by which the liquid level and, correspondingly, the hydrostatic bore hole pressure in the well is controlled, the apparatus comprising: a vertically adjustable sump or fluid trap for receiving fluid from the formation positioned in said bore hole or well casing, said sump being defined by a sump casing having its external wall spaced from the internal wall of said bore hole or well casing to leave an annulus therebetween through which fluid passes, said sump casing being closed at the bottom and having a fluid inlet above the bottom; a submersible pump mounted in said sump casing for pumping fluid which enters the sump to the surface; production tubing leading from said pump to the surface through which said fluid is pumped to the surface; and pump actuating means actuated by the fluid level in said sump for starting and stopping the operation of said submersible pump; whereby fluid entering said bore hole or well casing passes through said sump on its way to the surface and the liquid level in the bore hole or well casing is controlled by the vertical positioning of said sump in the bore hole or well casing.

The term "bore hole" is used herein to mean the opening in the well and the term includes the well casing. Accordingly, such phrases as "a sump positioned in said bore hole" includes the sump being positioned in the well casing.

DESCRIPTION OF THE PREFERRED EMBODIMENTS

The method and apparatus of the invention will be described by their application to pumping oil from an oil well.

The illustrative embodiment is described as used with a well bore having a casing therein; however, the invention also has application for use in pumping fluids from well bores wherein casings are not necessary. If a casing is used it may or may not extend to the bottom of the bore hole.

The invention will now be described with reference to the accompanying drawings.

Figure 1:
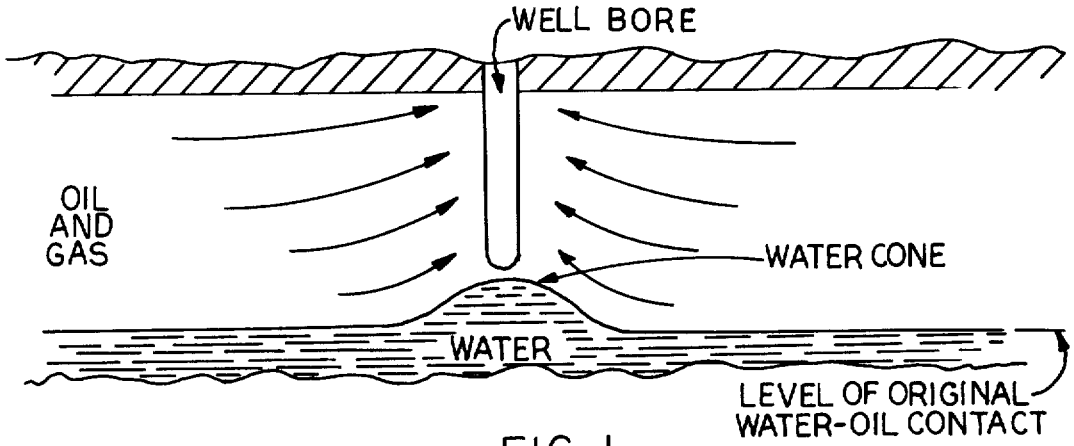
FIG. 1 is a schematic showing of the formation and growth of a water cone in the formation.
Figure 2:
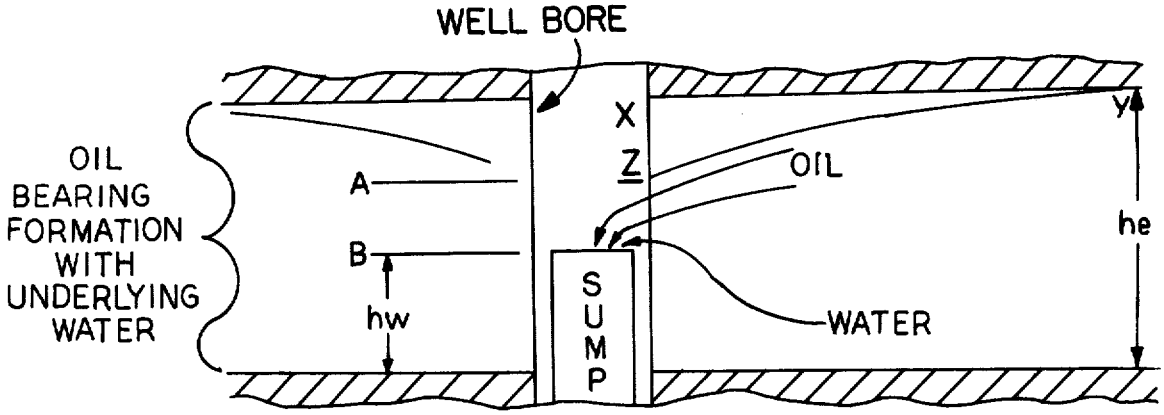
FIG. 2 is a schematic showing of an oil bearing formation with underlying water, depicting the measure of the driving head, Re-Rw, showing how the area fluids enter the well bore A and the zone drainage of movable fluids, x,y,z.
Figure 3:
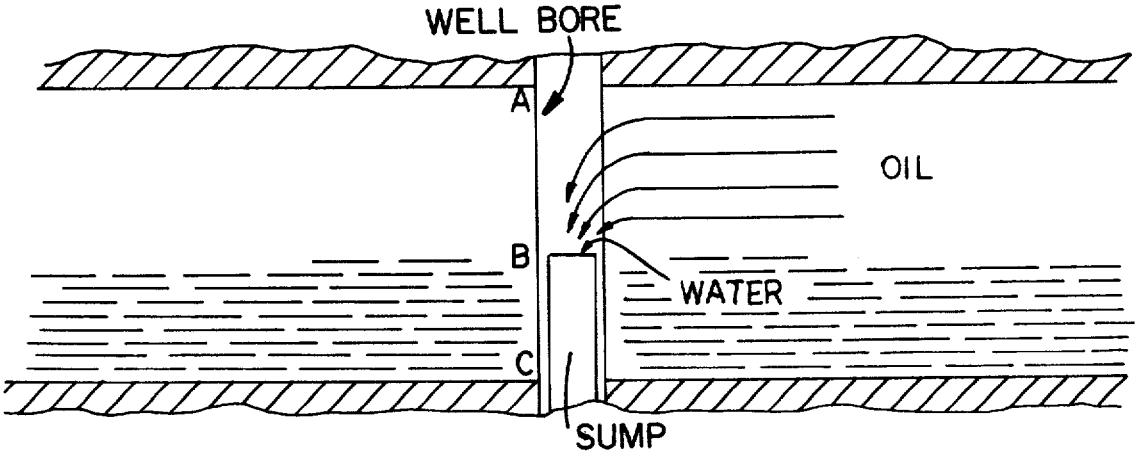
FIG. 3 is a schematic showing of water entering the well bore to be drawn off at B, section A-B showing where oil enters the well bore unimpeded by water, and section B-C showing where the back pressure and damming effect occurs.
Figure 4:
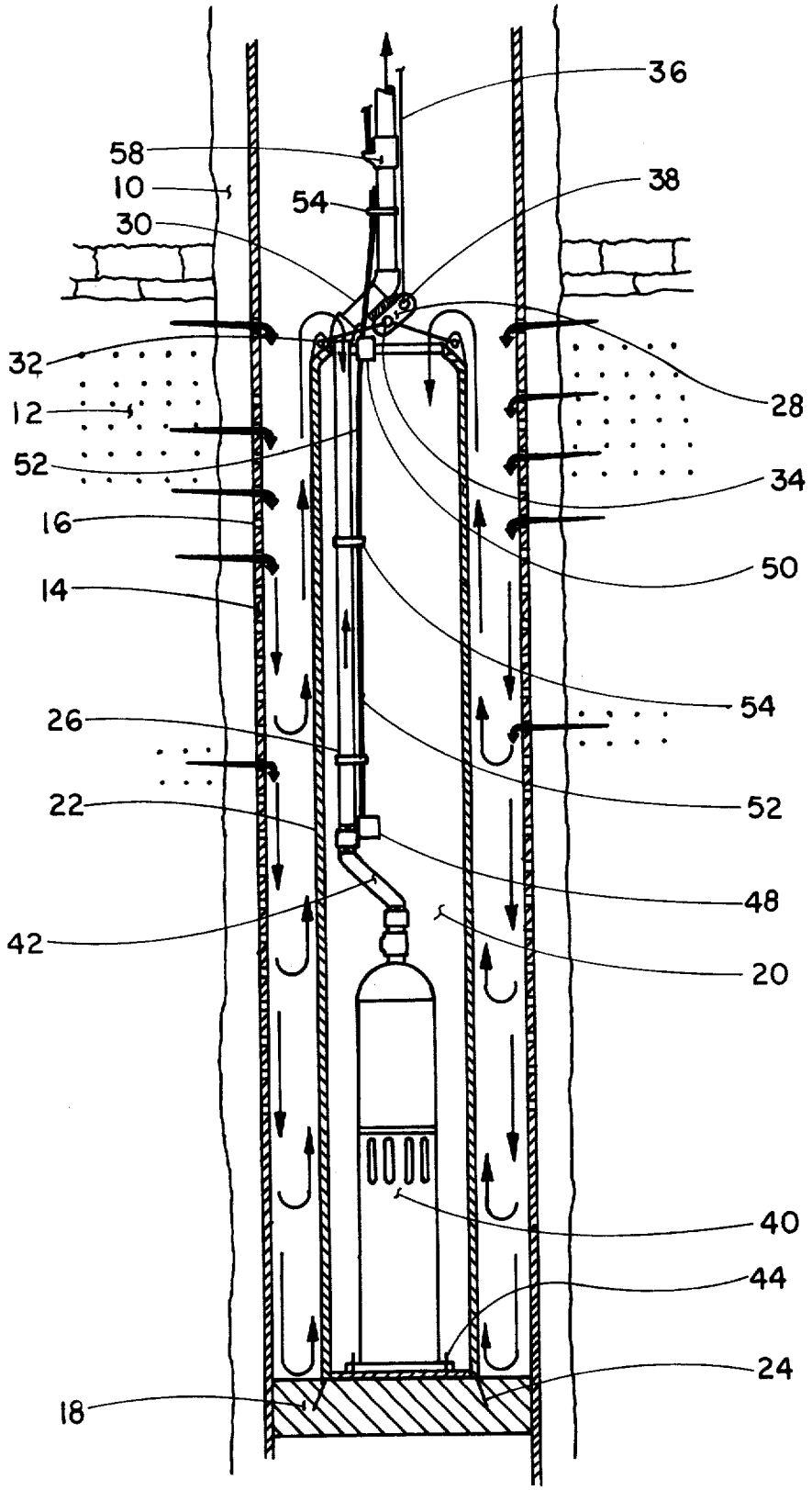
FIG. 4 is a partial cross-section of the pumping system of the invention installed for operation in a well casing which is in turn installed in a well bore.

Referring to FIG. 4, the number 10 represents a well bore in an oil bearing formation 12. A string of oil well casing 14 is shown positioned within the oil bearing formation 12. Arrows indicate the direction of flow of oil from the oil bearing formation into the well casing.

A conventional packer 18 may be used at the bottom end of the well casing 14.

A sump indicated generally at 20 is defined by sump casing 22, the sump being mounted within well casing 14, being of substantial length, having a closed bottom, and an open top as shown for insertion of the pump and entry of fluid. The sump could be closed around the production tubing and other provisions for entry of fluid into the sump could be made, such as, a hole in the sump casing near the top. The sump in this case is of a circular construction but it may have other cross sectional configurations. The outside diameter of the sump is of a size that will permit it to pass easily to the bottom of the well bore. The position of the sump will depend upon the characteristics of the oil bearing formation but generally its bottom should be located at least fifty feet below the oil yielding sand and its top or the point of entry of fluid, even with or below the point where fluid enters the well bore from the formation. It can be positioned outside these limits depending on the condition of the well bore. The fluid capacity of the sump is governed by its dimensions which are in turn governed by well bore conditions. It is preferred that the well bore extend a certain distance below the point of entry of the fluids that are to be pumped to the surface. The sump may rest on the bottom of the well bore and may be anchored by sump anchoring pins to keep the sump from rotational movement due to torque caused by spin of the pump motor. Use of rigid tubing prevents circular movement of the sump. The sump, of course, is vertically adjustable by raising or lowering the production tubing.

If the production pipe 26 is made of plastic the sump casing 22 is anchored to the production pipe 26 in the following manner: a metal adapter 28 is securely attached to the upper offset nipple 30 by conventional means. The sump casing 22 is provided with a sump anchoring harness 32 which is attached to lower hole 34 of adapter 28. In order to reinforce the plastic production pipe 26 as the assembly is being pulled, a cable 36 of steel or other strong material is attached by its lower end to the upper hole 38 of the adapter and extends to the surface. As is well known, without such a support the plastic tubing would stretch under the weight of any contained fluids plus the weight of all other items suspended on the tubing. If the production pipe is made of rigid material, such as metal or fiberglass, the supporting cable 36 is not necessary and the sump casing 22 and auxiliary equipment can be pulled for repair or other reasons by means of the rigid production tubing to which the harness 32 will be attached. The same arrangement can be used for attaching the harness to the rigid tubing with a metal-to-metal adapter, for example, being used.

For pumping oil to the surface which enters the sump, a pump 40 of the submersible type is positioned on the bottom of the sump casing 22. The pump 40 is preferably attached to the bottom of the sump casing by means of attachment pins shown schematically at 44. This is to prevent its movement relative to the sump under torque conditions. The design of the conventional electric submersible pump is uniquely adaptable to the concept of the pumping being controlled by the entry of fluid into the well bore. It is only necessary for use of this pump in this application to remove the check valve at the top of the pump. The outlet at the top of pump 40 is preferably connected to production pipe 26 by means of lower offset rigid nipple 42 to provide maximum space inside the sump casing for switch elements. The primary reason for offset nipples 30 and 42 is to move the production tubing 26 off center so as to provide sufficient space to emplace the liquid level operated switches 48 and 50.

The structure by which pumping is controlled by the entry of fluid into the well bore and, correspondingly, the sump will now be described. A lower liquid level operated switch 48, or its fluid actuated mechanism, is mounted, preferably on the production pipe 26, near the upper outlet of the pump 40. A second upper liquid level operated switch 50, or its fluid actuated mechanism, is mounted upwardly from the lower switch and is mounted near the upper outlet of the sump casing 22. This latter switch can be mounted slightly above the lip of the sump casing.

The positions of the lower and upper liquid level switches is not limited to being adjacent the top of the pump and the top of the casing, respectively, the preferred locations for efficiency, it only being necessary for operativeness that one switch be located above the other.

The liquid level operated switches 48 and 50 may be of a conventional sensor type which responds to magnetic pressure, thermal, etc. means and which are capable of transmitting a signal to the holding relay 57.

Figure 6:
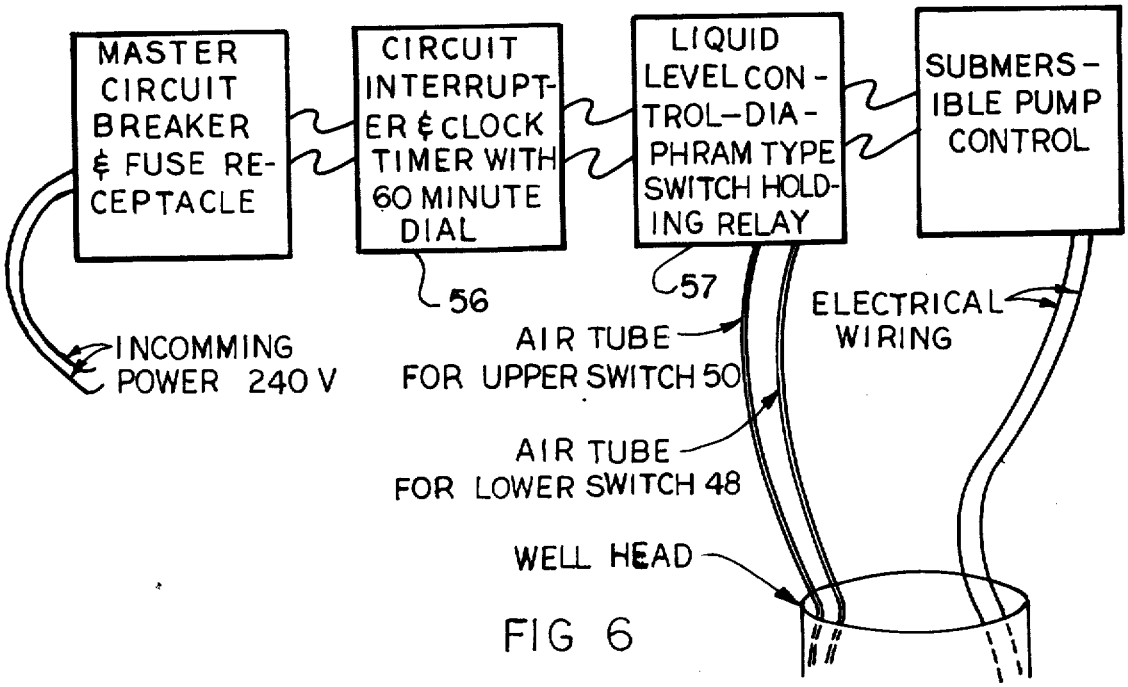
FIG. 6 is a schematic circuit diagram of the circuitry for operating the pump, liquid level operated switches, and clock timer.

The switches 48 and 50 are connected in the electrical circuit which operates the pump as shown in the circuit diagram of FIG. 6. It will be seen that fluid entering the well bore and passing through the perforations 16 in the well casing will travel downwardly in the annulus between the inner surface of the well casing and the outer surface of the sump casing and then travel up over the lip of the sump casing as shown by the arrows. When no well casing is used the surface of the bore hole takes the place of the casing. Switches 48 and 50 operate in conjunction with a holding relay 57 in the liquid level control unit of FIG. 6. When the oil level reaches the switch 48 it will close the switch but this will not actuate the pump 40. When the oil travels up through the sump to the switch 50 it will close this switch, and then the current will pass through the holding relay 57 to actuate the pump to pump oil from the sump out of the well through production pipe 26 for recovery of the oil at the surface. When the oil level sinks below upper switch 50 it will open the switch but the pump will not stop operating until the oil level sinks below the switch 48 to open it and this breaks the current through the holding relay and stops the pump action. The described construction insures that the pump will start operating as soon as the sump casing 22 is filled and will not stop operating until the level of oil in the sump casing reaches the lower switch 48 near the inlet of the pump. The bell type switches shown are connected by air tubes 52 anchored at the point 54, as shown schematically. When electrically operated switches are used wiring would replace the air tubes. The switches are incorporated into the circuit which operates the pump 40 as shown in the schematic diagram of FIG. 6.

It is to be understood that the term "switch" as used herein and in the claims includes the fluid actuated element of the switch to cover the case where other parts of the switch may be spaced apart from the fluid actuated element. The term "annulus" refers to the space between the internal surface of the well casing and the external surface of the sump and need not extend entirely around the well casing. When no well casing is used the term refers to the space between the bore hole surface and the sump casing.

The submersible pump 40 is lowered into the sump casing and pulled from the well casing along with the sump casing, as will be apparent from the construction described above in which the sump casing 22 and the submersible pump 40 are attached to the production pipe 26.

The construction by which gas locks occurring in the pumping circuit are removed will now be described. The gas bubbles causing the gas lock are removed from the pumping circuit by stopping the operation of the pump with a circuit interrupter 56 and allowing oil below a certain point to flow by gravity back through the production pipe into the pump to dislodge the gas bubbles.

As is well known, hydrocarbons emanating from the formation foam and create gas bubbles upon agitation in the pumping system. Since the impeller section of the submersible pump used in the described modification is short, it does not take a very large gas bubble to create a gas lock. When this occurs, the continuously spinning impellers cannot get a firm hold on the foamy gas bubbles and so will not dislodge them. Consequently, fluid which is supposed to be rising toward the surface through the tubing remains stationary, or very nearly stationary. Fluid will continue to enter the well bore and rise upwardly in the well bore beyond the sump keeping both liquid level actuated switches closed; consequently, the pump motor will continue to run without oil being raised to the surface. By interrupting the electric circuit for a few seconds in order to stop the pump motor, gas bubbles will be dislodged as described above and the production system will stabilize and continue working properly until the next gas bubbles form.

Figure 5:
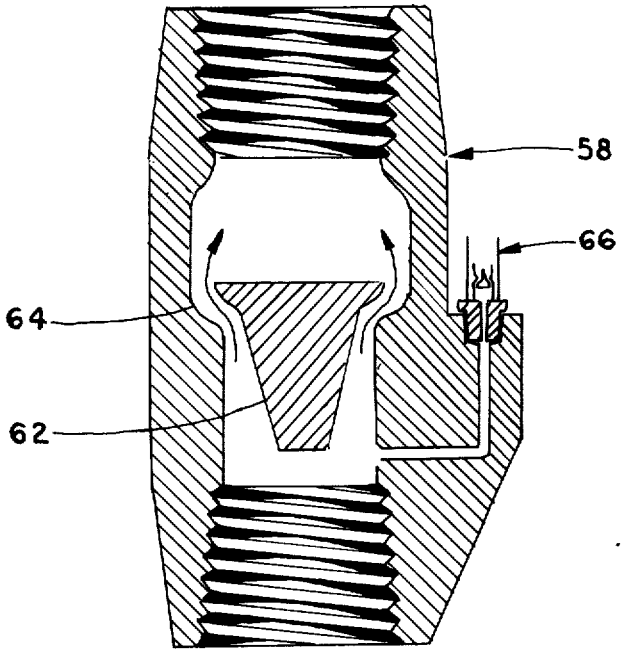
FIG. 5 is a vertical cross-section of the check valve and air inlet adapter mounted in the productin tubing of the pumping system.

The interruption of the pump circuit is accomplished by means of a clock timer 56 incorporated in the main circuit between the main circuit breaker and the fluid level control case as shown an the circuit diagram of FIG. 6. The clock timer should be one capable of breaking the circuit in thirty second increments which increments can be set 1, 2, 3 or more times per hour. This shutting off of the pump permits fluid within the tubing below the check valve 58, FIG. 5, to fall back through the pump impeller section and thereby dislodge the gas lock. The frequency with which gas locks form vary from well to well and even in the same well.

The structure by which oil above a certain point in the production pipe is prevented from moving downward, and the structure by which the oil below this point is permitted to move downward when the pump stops, will now be described. This structure comprises a conventional adapter 58 (FIG. 5) which is incorporated into the production pipe 26 by threaded inserts in the end of the production pipe 26. If the production pipe is made of plastic, a conventional adapter for insertion in the plastic pipe is used.

The check valve 58 is comprised of a vertically movable valve element 62 which seats in valve seat 64. It is threadably inserted in the production tubing. In the operation of this conventional and well known structure, the valve element 62 is unseated upwardly by the upward flow of fluid through the production pipe. When the motor of the pump 40 is shut off by the clock timer 56 the valve element 62 will seat on seat 64 to prevent any oil above the valve element from passing downwardly through the valve. Oil below the closed valve element will flow by gravity back down the production pipe 26 into the pump 40 to dislodge any gas bubbles in the pump circuit. An air vent valve represented generally at 66 is provided to permit the inlet of air into the production pipe 26 below the valve element 62 to permit the oil below the valve element to flow downwardly to the pump 40. The air vent 66 is provided with a one-way valve similar to that used in the ordinary inner-tube of an automobile tire and permits air to pass through the valve into the tubing but closes under outward pressure. This permits fluid below the check valve to drop back through the impeller to dislodge gas bubbles when the check valve closes.

The overall operation of the above described structure will now be described.

Fluid from the oil bearing formation 12 enters the well bore 10 under hydrostatic pressure and gas expansion at a relatively constant rate, passing through the perforations 16 in the well casing 14 to fill the annulus between the well casing 14 and the sump casing 22. When the rising fluid reaches the lip of the sump 20 it pours over the lip into the sump. As the fluid level rises in the sump 20 it covers the bottom switch 48 and causes this switch to close. The fluid continues to rise within the sump 20 until the top switch 50 is reached and when this switch is covered it closes. With both switches closed an electric current passes through the holding relay 57 (FIG. 6) to the pump motor and the motor spins the impellers to pump fluid up through the production pipe 26. As fluid is pumped to the surface faster than it enters the sump, the sump begins to void and the level of the fluid in the sump lowers. As soon as the upper switch is uncovered it opens but the current circuit is maintained by the holding relay. The fluid level continues to fall and as soon as the lower switch is uncovered it opens and this releases the holding relay which opens the circuit and the pump stops. The sump then refills and the cycle is repeated. It is thus seen that the fluid level in the well is controlled by the vertical position of the fluid inlet of the sump. The duration of the pumping cycle will depend on the amount and rate or the yield of the formation, which varies from well to well. However, the described construction keeps the fluid moving through the formation regularly and provides for a uniform flow of fluid, in contrast to the highly intermittent operation of conventional mechanical pumping systems using walking beam jack, tubing and sucker rods which are now in general use.

The sump provides a reservoir for holding the fluid which is to be propelled to the surface with each pumping cycle.

The vertically adjustable sump, in conjunction with the pump and liquid level operated switches controlled by fluid entry into the well bore provide a means to obtain the maximum pressure differential between the formation and the well bore by constantly maintaining a minimum possible fluid level within the well bore. This is accomplished by the above described construction and by proper positioning the fluid entry point of the sump with respect to the point of entry of fluid from the formation into the well. The vertical positioning of the sump as required is, of course, accomplished by vertical movement of the production pipe 26 to which the sump casing 22 is attached. Where conditions within the well permit, it is preferred to position the fluid inlet of the sump near the upper boundary of the foundation.

As is well known, the pressure in the formation is greater than that in the well bore providing the fluid level in the well bore is constantly maintained as low as possible. After formation energy or pressure due to gas expansion is used up, fluid may still enter the well bore being moved by force of gravity.

The invention provides a number of advantages over prior art pumping systems. Among these are the fact that it provides for a maximum use of the force of gravity to move fluids into the well bore for pumping to the surface, and particularly, oil wells which have seemingly reached the stripper stage. When the pumping system of the invention is used in secondary recovery operations, the invention reduces the chances of the flood bank to set up and outrun the pumping system, because submersible pumps, acting automatically, have a superior range of pumping capacity. The system operates just as effectively in new oil wells. The adjustibility of the vertical position of the sump permits placement of its inlet at or below the point where fluid enters the well bore from the formation to control the fluid level in the well. A significant advantage stemming from the use of the system is that the lowest possible internal hydrostatic pressure in the well casing can be maintained so that the maximum pressure differential between that in the well casing and that in the formation is achieved with the result that the most favorable conditions are established for the entry of fluid into the well bore from the formation. The pumping system successfully implements the concept of controlling the pumping cycle by fluid entry into the well bore so that the fluid level in the bore hole is constantly maintained as low as possible.

What is claimed is:

1. Pumping apparatus for pumping fluid from a bore hole in a fluid producing formation to the surface comprising: sump means for receiving said fluid from the bore hole positioned in said bore hole; production tubing through which fluid in the bore hole travels to the surface; pumping means positioned in said sump means for pumping fluid entering said sump means through said production tubing to the surface for recovery; and pump actuating means activated by the fluid level in said sump means for starting and stopping the operation of said pumping means; whereby fluid entering said bore hole from the formation passes through the sump means on its way to the surface and the liquid level in the bore hole is controlled by the vertical positioning of said sump means.

2. The pumping apparatus of claim 1 in which said pump actuating means comprises a lower fluid level activated switch in said sump means and an upper fluid level activated switch in said sump means upwardly spaced from said lower switch, said switches operative to start and stop said pump when they are both closed and opened, respectively.

3. The pumping apparatus of claim 2 including a holding relay connected with said switches and pump and operative to cause said pump to start and stop, respectively, upon the closing or opening of both switches.

4. The pumping apparatus of claim 1 including means for periodically shutting off said pumping means, means in said bore hole above said sump for preventing backflow of fluid which is above a certain point when said pumping means is shut off, and means for permitting fluid below said certain point to flow downwardly to said pumping means when said pumping means is shut off.

5. The pumping apparatus of claim 1 in which a well casing is positioned in said bore hole and said sump means is vertically adjustable and positioned in said well casing.

6. The pumping apparatus of claim 5 in which said sump means is defined by a sump causing defining an annulus between its external surface and the internal surface of said bore hole.

7. The pumping apparatus of claim 1 in which said sump means is vertically adjustable and positioned in said bore hole with its upper boundary about at or below the point where fluid is coming from the formation.

8. Pumping apparatus for pumping fluid from a bore hole in a fluid producing formation having a string of tubing or well casing mounted therein which is in part perforated to permit entry therein of fluid from the formation, comprising: a vertically adjustable sump or fluid trap for receiving the fluid from said well casing positioned in said well casing, said sump being defined by continuous sump casing having its external wall inwardly spaced from the internal wall of said well casing to leave an annulus therebetween through which fluid passes, said sump casing being closed at the bottom and having a fluid inlet above the bottom; a submersible pump mounted in said sump casing for pumping fluid which enters said sump to the surface; production tubing leading from said pump to the surface through which said fluid is pumped for recovery; and pump actuating means activated by the fluid level in said sump for starting and stopping the operation of said submersible pump; whereby fluid entering said bore hole passes through said sump on its way to the surface and the liquid level in the bore hole is controlled by the vertical positioning of said sump.

9. The pumping apparatus of claim 8 in which said pump actuating means comprises a lower fluid level activated switch in said sump casing and an upper fluid level activated switch in said sump casing above the other switch, said switches operative to start and stop said pump when they are both closed and opened, respectively.

10. The pumping apparatus of claim 9 including a combination check valve and air vent mounted in said production tubing above said pump for dislodging gas bubbles in the pumping circuit causing gas locks, said check valve operative to permit the passage of upwardly moving fluid and block the passage of downwardly moving fluid, said air vent including a one-way valve operative to permit passage of air into said production tubing below said check valve; whereby when said pump stops said check valve will close to prevent the downward passage of fluid which is above the valve, and fluid below the check valve will drop through the production tubing and pump impeller section to dislodge gas bubbles; and a timer operatively connected to said pump for periodically stopping the operation of said pump.

11. The pumping apparatus of claim 8 including a combination check valve and air vent mounted in said production tubing above said pump for dislodging gas bubbles in the pumping circuit causing gas locks, said check valve operative to permit the passage of upwardly moving fluid and block the passage of downwardly moving fluid, said air vent including a one-way valve operative to permit passage of air into said production tubing below said check valve, whereby when said pump stops and check valve will close to prevent the downward passage of fluid which is above the valve, and fluid below the check valve will drop through the production tubing and pump impeller section to dislodge the gas bubbles; and a timer operatively connected to said pump for periodically stoping the operation of said pump.

12. Pumping apparatus for pumping fluids from a bore hole in a fluid producing formation having a string of tubing or well casing mounted therein, which is in part perforated to permit entry therein of fluid from the formation, comprising: a vertically adjustable sump or fluid trap for receiving the fluid positioned in said well casing at a point even with or below that at which fluid enters said well casing from the formation, said sump being defined by a sump casing having its external wall inwardly spaced from the internal wall of said well casing to form an annulus therebetween through which fluid passes, said sump casing being closed at the bottom and open at the top; a submersible pump mounted in said sump casing near its bottom for pumping fluid to the surface which enters said sump; production tubing leading from said pump to the surface through which said fluid is pumped to the surface for recovery; a fluid level activated switch near said pump and a fluid level activated switch near or at the top of said sump casing, said switches operative to start and stop said pump when they are both closed and both open, respectively; a combination check valve and air vent mounted in said production tubing above the upper end of said sump for dislodging gas bubbles causing gas locks in the pumping circuit, said check valve operative to permit the passage of upwardly moving fluid and block the passage of downwardly moving fluid, said air vent including a one-way valve operative to permit the passage of air into said production tubing below said check valve whereby when said pump stops said check valve will close to prevent the downward passage of fluid which is above the valve, and fluid below the check valve will drop through the production tubing and pump impeller section to dislodge the gas lock; and a timer operatively connected to said pump for periodically stopping the operation of said pump; whereby fluid entering said well casing passes through the sump, the positioning of sump controls the level of fluid in said well casing, and gas bubbles forming in said pump body are periodically dislodged.

13. In a well pumping system wherein the fluid in the well is pumped to the surface through production tubing by a pump connected to the tubing located in the bore hole or a well casing in said bore hole, the improvement for dislodging gas bubbles occurring in the pump body causing gas locks comprising: means for periodically shutting off said pump; means in said production tubing above said pump for preventing downward flow of fluid which is above a certain point when said pump is shut off, and means for permitting fluid below said certain point to flow downwardly to said pump when said pump is shut off in order to flush out and dislodge said gas bubbles.

14. In a well pumping system wherein the fluid in the well is pumped to the surface through production tubing by a pump connected to the tubing located in the bore hole or well casing in the bore hole, the improvement for dislodging gas bubbles occurring in the pump body causing gas locks comprising: a timer for periodically shutting off said pump; a combination check valve and air vent mounted in said production tubing above said pump, said check valve operative to permit the passage of upwardly moving fluid and block the passage of downwardly moving fluid, said air vent including a one-way valve operative to permit passage of air into said production tubing below said check valve; whereby when said pump stops said check valve will close to prevent the downward passage of fluid which is above the valve, and fluid below the check valve will drop through the production tubing and pump impeller section to dislodge the gas bubbles.

15. A method for recovering fluid from a bore hole into which said fluid is entering from a formation while controlling the level of fluid in the bore hole, which comprises:

(a) flowing said fluid into a vertically adjustable container for said fluid positioned in the bore hole and having a pump positioned therein;

(b) pumping said fluid from said container to the surface at a rate at least equal to the rate at which the fluid is entering the bore hole;

(c) controlling the pumping of said fluid to begin the pumping at a first level of the fluid in the container and to cease the pumping when said fluid has sunk to a second level in said container below said first level, and (d) vertically positioning said container in the bore hole to provide a substantially optimum level of fluid in the bore hole.

16. The method of claim 15 in which said container is positioned in the bore hole with its fluid inlet point about even with or below the point at which said fluid is entering the bore hole from the formation.

17. The method of claim 15 including the bore hole having a well casing positioned therein, and positioning said enclosure in the well casing.

18. The method of claim 15 including an annular space between said container and said bore hole through which fluid travels from the formation to the container.

19. A method for recovering fluid from a bore hole when said fluid includes both oil and water entering from a formation, said fluid being driven by gas expansion and reservoir pressure, which comprises:

(a) positioning a vertically adjustable enclosure or pump-off chamber in the bore hole to form an annulus between the enclosure and the bore hole;

(b) causing said fluid to flow into said annulus and then into said enclosure by gas expansion and reservoir pressure;

(c) positioning a pump with excess pumping capacity in said pump-off chamber to pump said fluid to the surface at a rate at least equal to its rate of entry into the bore hole in order to keep an area of the well bore free of fluid at all time so as to prevent at all times any back pressure from being exerted on the formation and to keep the water pumped off from a point below where oil enters from the formation so that the water does not affect the rate of entry of oil from the formation to the bore hole.

20. The method of claim 19 including the bore hole having a well casing positioned therein, and positioning said enclosure in the well casing.

* * * * *